US005285531A

United States Patent [19]

Nalbandian

[11] Patent Number: 5,285,531

[45] Date of Patent: Feb. 15, 1994

[54] FEMALE GARMENT

[76] Inventor: Robert M. Nalbandian, 1 E. River Rd., Tucson, Ariz. 85704

[21] Appl. No.: 941,383

[22] Filed: Sep. 4, 1992

[51] Int. Cl.[5] ..... A41D 27/00; A41B 9/04

[52] U.S. Cl. ..... 2/406; 2/275; 2/400; 2/243.1; 450/156

[58] Field of Search ..... 2/67, 73, 275, 400, 2/402, 403, 406, 243 R, 243 A; 450/98, 99, 92, 156

[56] References Cited

U.S. PATENT DOCUMENTS

| | | | |
|---|---|---|---|
| 1,126,379 | 1/1915 | Brown | 2/400 X |
| 2,493,357 | 1/1950 | Miller | 2/406 |
| 2,668,953 | 2/1954 | Tofanelli | 450/99 |
| 2,928,397 | 3/1960 | Pucci | 450/99 |
| 2,980,114 | 4/1961 | Montoya | 450/99 |
| 3,298,373 | 1/1967 | Marchisella | 450/99 |
| 4,179,754 | 12/1979 | Denu | 2/67 |
| 4,683,594 | 8/1987 | Feinberg | 2/114 |
| 4,753,182 | 6/1988 | Blackburn | 2/275 X |
| 4,872,221 | 10/1989 | Stone, III | 2/275 X |
| 4,915,046 | 4/1990 | Meistreu | 2/275 X |

*Primary Examiner*—Clifford D. Crowder
*Assistant Examiner*—Jeanette E. Chapman
*Attorney, Agent, or Firm*—Rosenbaum & Associates

[57] ABSTRACT

The present invention provides a female garment with an infolding or cleft at the surface level of the labia majora to subtly define the contours of the external female genitalia. The linear infolding is in the sagittal plane of the body and has a first material which represents the outer cloth surface of the female garment and a second, firmer material which is attached to the inner surface of the first material so that the subtle contours of the external female genitalia are maintained throughout the infolding. Alternatively, the features of the external female genitalia in situ may be represented in a variety of female garments by utilizing first and second layers where the first layer constitutes material of the female garment and the second layer constitutes material of a different color or texture from that of the first material.

8 Claims, 1 Drawing Sheet

FEMALE GARMENT

BACKGROUND OF THE INVENTION

The present invention relates generally to a female garment with a subtle infolding and/or topographical demarcation by various methods (e.g. tinting, coloring, or textural features) in the area of the external female genitalia. More particularly, the present invention relates to a female garment with an anatomically correct design which suggests a linear infolding or cleft in order to define the contours of the external female genitalia at the surface level of the labia majora. The inventive female garment design can be used for jeans, shorts, bathing suits, lingerie, under garments, leggings, and all other garments worn by women from the pelvis to the knees or lower.

Due to the Acquired Immune Deficiency Syndrome (AIDS) epidemic, there has been a distinct and ever increasing trend towards the sublimation of sexual matters by the use of language, dances, pictures, and non-verbal symbols in contrast to and substitution for the previously prevalent, explicit attitudes toward casual sexual activity. The present invention provides a variety of female garments by which female individuals can sexually express themselves short of exposing themselves and short of engaging in the relaxed sexual activity which was commonplace in the pre-AIDS years.

SUMMARY OF THE INVENTION

It is an object of the present invention to provide a new female garment which creates a subtle, understated sexual signal that imparts sexual communication without being overt. It is a further object of the present invention to provide a female garment which evokes a subtle simulated non-verbal communication.

Accordingly, the inventive female garment consists generally of a garment which is worn on the lower trunk of the female body such as pants, shorts, bathing suits, or leggings, with the garment further comprising a linear infolding, a cleft, or a delineated definition of the topographical contours of the female genitalia in situ. The female garment is worn in such a manner that the simulated features of the external female genitalia are topologically positioned to lie directly over the authentic external female genitalia. Simulated external female genitalia may be created by appropriate tailoring, tinting (coloring) or textural demarcations, or any combinations thereof. Two different and distinct types of material are used to create the infolding. The outer surface of the infolding reflects the material of the garment itself, i.e. the material from which the pants, shorts, leggings, or bathing suits are made, while the inside surface of the infolding, i.e. that surface of the infolding which comes into contact with the labia majora at the female pudendal introitus, is made of a firmer material than that material which comprises the outer surface of the infolding. This construction assists in maintaining the subtle contours of the female genitalia throughout the infolding. Alternatively, the female genitalia may be represented by coloring or tinctorial delineations in situ in the several types of clothing cited above.

The objects and advantages of this invention will appear more fully from the following more detailed description of the preferred embodiments of the invention made in conjunction with the accompanying drawings.

DETAILED DESCRIPTION OF THE PREFERRED EMBODIMENTS

Figure 1:
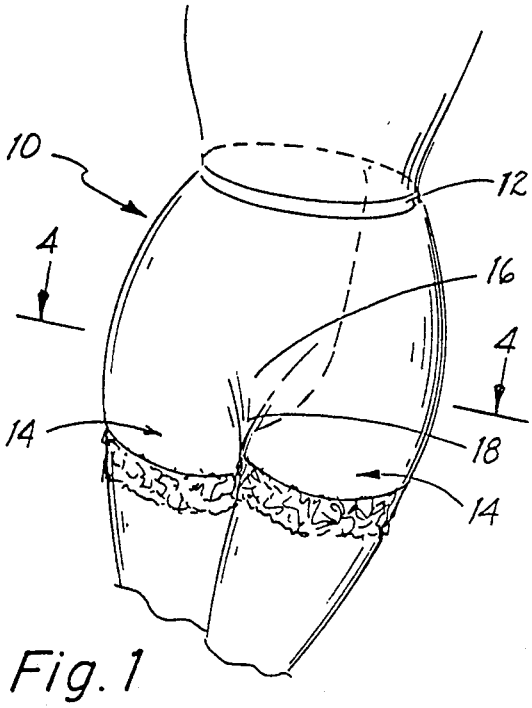
FIG. 1 is a front perspective view of a first preferred embodiment of the inventive female garment with the posterior portion of the garment in phantom.

FIG. 1 illustrates one preferred embodiment of the female garment 10 of the present invention. Although the invention relates particularly to a woman's underwear shorts in the first preferred embodiment in FIG. 1, the spirit and scope of the invention is also applicable to other garments such as lingerie, bathing suits, shorts, leggings, and pants worn as outerwear. These garments along with any other garments which cover the area of the female genitalia are encompassed by the present invention.

The female garment 10 shown in FIG. 1 includes elements and features that are already known in the prior art as well as some new elements. Generally, the waistband 12, leg encircling openings 14, and crotch portion 16 between the leg encircling openings 14 are known in the prior art. However, the linear infolding or cleft 18 which defines the contours of the female pudenda at the surface level of the labia majora is new in the art.

Figure 2:
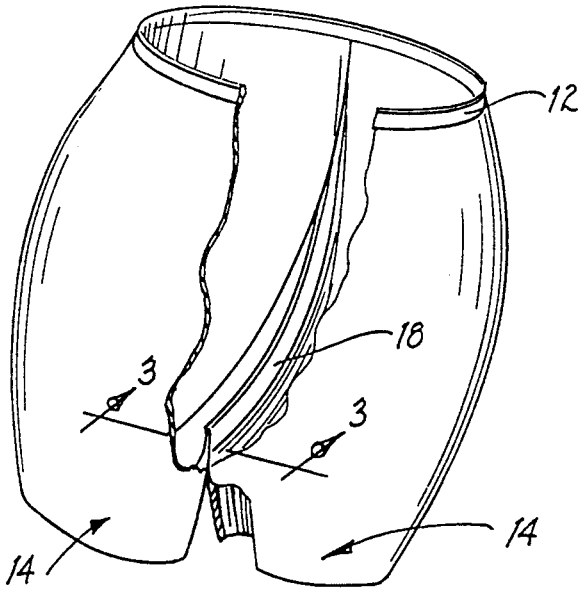
FIG. 2 is a partially fragmentary back perspective view of a preferred embodiment of the inventive female garment, portions shown cut away to illustrate body-engaging portions of the garment.

FIG. 2 shows an isometric partial cutaway view of the back of the garment illustrated in FIG. 1. FIG. 2 displays the waistband 12 at the top of the female garment, the leg encircling openings 14 at the bottom of the garment, and a crotch portion between the leg encircling openings 14 which contains the improvement, namely the linear infolding or cleft 18 which engages the female genitalia at the surface level of the labia majora.

Figure 3:
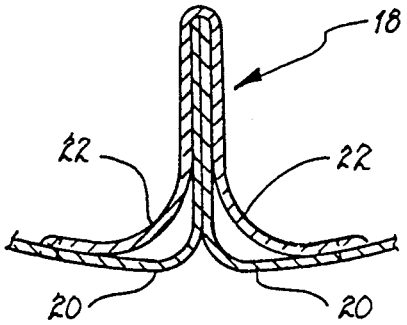
FIG. 3 is a cross-sectional view taken along line 3—3 of FIG. 2. The transverse cross-section is taken at the "in situ" position of the external female genitalia at right angles to the adjacent plane of the skin.

FIG. 3 represents a cross-section through the infolding or cleft 18, which engages the labia majora of the female genitalia, taken along line 3—3 of FIG. 2. The infolding or cleft 18 may be composed of two different types of material. A first material 20 represents the outer cloth surface of the inventive female garment 10. The first material 20 is preferably comprised of a material which is capable of conforming to the contours of the external female genitalia such as cotton, polyester, nylon, or lycra spandex. However, any other cloth material which is currently used for women's jeans, shorts, bathing suits, under garments, leggings, etc., may also be used as the first material 20, which represents the outer cloth surface, comprising the infolding or cleft 18 of the inventive female garment 10. The first material 20 is sewn to form a seam which engages with the female genitalia such that it may slightly separate the labia majora. A second material 22 is sewn around the inside of the seam created by the first material 20 so that subtle contours are maintained throughout the infolding or cleft 18 of the inventive female garment 10. Alternatively, the features of the external female genitalia may be defined by color, tinting, or texture.

Figure 4:
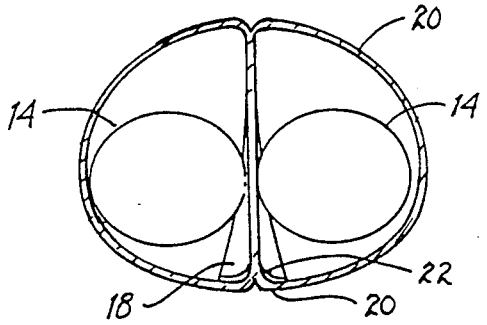
FIG. 4 is a cross-sectional view taken along line 4—4 of FIG. 1.

A cross-section of the inventive female garment 10 along line 4—4 of FIG. 1 is shown in FIG. 4. The female garment is worn by passing the wearer's legs through the leg encircling openings 14 and engaging the labia majora of the female genitalia with the infolding or cleft 18. As previously described, the infolding or cleft 18 is comprised of a first material 20 which represents the outer cloth surface of the inventive female garment 10 and a second material 22 which is of a firmer material than the first material 20.

Figure 1A:
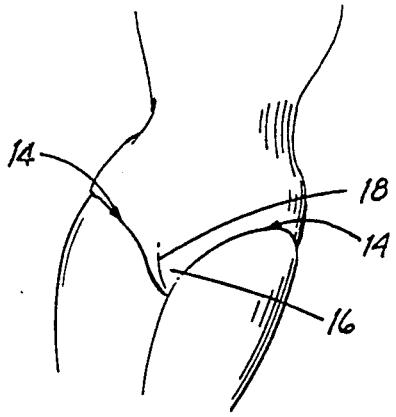
FIG. 1A is a front elevational view of a second preferred embodiment of the inventive female garment.

A second preferred embodiment of the female garment is illustrated in FIG. 1A. In this embodiment, there is no waistband. Instead, this embodiment depicts a bathing suit or body suit with leg encircling openings 14, a crotch portion 16 between the leg encircling openings 14, and a linear infolding or cleft 18 which defines the contours of the external female genitalia.

Although FIGS. 2–4 illustrate the construction of the infolding or cleft 18 as a first material and a second, firmer material which are sewn together to engage the labia majora and thereby define the contours of the female genitalia, this physical construction is not the exclusive means for creating the improvement to the inventive female garment. More particularly, other means exist for defining the contours of the female genitalia such as sketching artistic renderings by color or shading on the outer surface of the female garment. In addition, any other means for defining the contours of the external female genitalia on the outer surface of a female garment are clearly contemplated by the present invention.

The incorporation of the previously described female garment in other types of female wearing apparel such as lingerie, underwear, bathing suits, shorts, pants, and leggings is also contemplated by the present invention.

While preferred forms of the invention have been shown in the drawings and described, since additional variations in the preferred forms will be apparent to those skilled in the art, the invention should not be construed as limited to the specific forms shown and described, but instead is as set forth in the following claims.

I claim:

1. A female garment comprising:
a front portion;
a back portion;
leg encircling openings for allowing a wearer's legs to pass through said female garment;
a crotch portion located between said leg encircling openings comprising a first layer comprising the material of said female garment wherein said layer has an inner and outer surface and an infolding consisting of a single fold of said first layer, and a second layer attached to said inner surface of said first layer and over said single fold such that it simulates contours of the external female genitalia.

2. The female garment of claim 1, wherein said second layer comprises matter of a different color than said first layer.

3. The female garment of claim 1, wherein said second layer comprises matter of a different texture than said first layer.

4. The female garment of claim 1, wherein said female garment further comprises a waistband.

5. The female garment of claim 2, wherein said female garment further comprises a waistband.

6. The female garment of claim 3, wherein said female garment further comprises a waistband.

7. The female garment of claim 4, wherein said second material has a relatively higher tensile strength than said first material.

8. A female garment comprising:
a waistband;
a front portion;
a back portion;
leg encircling openings for allowing a wearer's legs to pass through said female garment;
a crotch portion;
a linear infolding formed in the crotch portion simulating the contours of the female genitalia and comprising a first material consisting of a single fold seam of said first layer which includes inner and outer surfaces, said inner and outer surfaces corresponding to interior and exterior surfaces of the female garment, respectively, and a second material attached to the inner surface of said first material such that said second material covers the single fold seam so that the contours of the external female genitalia are simulated throughout said linear infolding.

* * * * *